US005700005A

United States Patent [19]

Chen

[11] Patent Number: 5,700,005

[45] Date of Patent: Dec. 23, 1997

[54] APPARATUS FOR CONTROLLING SHEET FEED-OUT FROM AN AUTOMATIC SHEET FEEDER INTO A RECEIVING TRAY

[75] Inventor: Hsi-Min Chen, Hsinchu, Taiwan

[73] Assignee: Must Systems Inc., Taipei, Taiwan

[21] Appl. No.: 636,534

[22] Filed: Apr. 23, 1996

[51] Int. Cl.[6] ..... B65H 29/70

[52] U.S. Cl. ..... 271/188; 271/314

[58] Field of Search ..... 271/177, 184, 271/188, 314

[56] References Cited

U.S. PATENT DOCUMENTS

| | | | |
|---|---|---|---|
| 3,434,710 | 3/1969 | Yarger et al. | 271/188 |

FOREIGN PATENT DOCUMENTS

| | | | |
|---|---|---|---|
| 191958 | 9/1985 | Japan | 271/314 |
| 208773 | 8/1993 | Japan | 271/188 |
| 262446 | 10/1993 | Japan | 271/177 |
| 294530 | 11/1993 | Japan | 271/314 |

OTHER PUBLICATIONS

Engh, "Drum Card Stacker", IBM Tech. Disc. Bull., vol. 10, No. 3, p. 310, Aug. 1967.

Galatha et al, "Fixed Platform Stacker", IBM Tech Discl. Bull., May 1970, vol. 12, No. 12, p. 2296.

*Primary Examiner*—Boris Milef

*Attorney, Agent, or Firm*—Sughrue, Mion, Zinn, Macpeak & Seas, PLLC

[57] ABSTRACT

An apparatus for sheet feed-out control is provided on an automatic sheet feeder used in conjunction with scanners, fax machines, printers, copiers, and the like. The apparatus comprises a feed-in roller set for feeding the sheet into a scanning position where a scanning process is performed and a feed-out roller set for pulling the sheet away from the scanning position and delivering the sheet onto a receiving tray. A pivotal pressing member is pivotally affixed proximate to the feed-out rollers. The pivotal pressing member is pivotally turned by the sheet as the sheet is being fed out of the feed-out rollers. As the sheet is entirely fed out of the feed-out roller set, the pivotal pressing member presses down against the tail edge of the sheet, thus flipping the sheet off the feed-out roller set. Since the sheet can be placed flat on the receiving tray right after it is entirely fed out of the feed-out roller set, a stack of sheets after being scanned can be piled up neatly on the receiving tray. Further, since the feed-out roller set and the feed-in roller set can be made according to the same specification, manufacture cost is significantly reduced.

2 Claims, 3 Drawing Sheets

APPARATUS FOR CONTROLLING SHEET FEED-OUT FROM AN AUTOMATIC SHEET FEEDER INTO A RECEIVING TRAY

BACKGROUND OF THE INVENTION

1. Field of the Invention

The present invention relates to automatic sheet feeders commonly used on scanners, fax machines, printers, copiers, and the like, for conveying a stack of sheets through the scanning process, and more particularly, to an apparatus used on an automatic sheet feeder for controlling the feed-out of sheets from the scanning process into a receiving tray.

2. Description of Prior Art

A scanner, fax machine, printer, or copier customarily includes an automatic sheet feeder composed of at least a set of feed-in rollers for feeding a stack of sheets one by one into a scanning position in the machine and a set of feed-out rollers for pulling the sheet away from the scanning position and delivering the sheet to a receiving tray. It is usually a major requirement from scanner users that the sheets after being scanned be piled up neatly on the receiving tray.

Referring to FIG. 1, there is shown a schematic diagram of a conventional automatic sheet feeder in a scanner. The automatic sheet feeder is composed essentially of a feed-in roller set 110 including at least a top roller 111 and a bottom roller 112 for feeding a sheet S into a scanning position P in the scanner and a feed-out roller set 120 including at least a top roller 121 and a bottom roller 122 for pulling the sheet S away from the scanning position P and delivering the sheet S to a receiving tray T. Passing through the scanning position P, the data on the sheet S is scanned by a scanning device (not shown) into digital form. The scanning device and process are conventional techniques which are within the scope of the present invention, so that description thereof will not be further detailed.

After passing through the scanning position P, the leading edge of the sheet S will be sucked by the feed-out roller set 120 which then gradually pulls the sheet S away from the scanning position P and eventually delivers the sheet S out of the scanner onto the receiving tray T.

As the feed-out roller set 120 feeds the sheet S entirely out of the scanner, it is usually an undesired result that, in case the surface of the bottom roller 122 is smooth, the tail edge of the sheet S would be left abutting on the bottom roller 122. Most of the time, the tail edge of the sheet S would be left there until the leading edge of the next sheet is being fed out of the feed-out roller set 120 which pushes against the tail edge of the sheet S. In this case, however, the current sheet S could be pushed all the way over the receiving tray T and thus away from the proper position on which the sheet S should be placed on the receiving tray T. As a result, a stack of sheets after being scanned could be messily piled on the receiving tray T. To solve this problem, there exists a need for a mechanism that can flip or move the sheet entirely away from the feed-out roller set 120 once the whole of the sheet is fed out of the feed-out roller set 120.

Referring to FIG. 2, a first conventional solution to the foregoing problem is to provide a ring of projecting lugs 122*a* circumferentially at equal intervals at each of the two ends of the bottom roller 122. Once the whole of the sheet S is fed out of the feed-out roller set 120 and has its tail edge left abutting on the bottom roller 122, the projecting lugs 122*a*, due to the rotation of the bottom roller 122, would come into contact with and urge against the tail edge of the sheet S, thereby flipping the sheet S off the bottom roller 122, allowing the tail edge of the sheet S to fall by gravitation on the receiving tray T. The result is a neatly piled stack of sheets that have been scanned.

The foregoing solution, however, has several drawbacks. First, the bottom rollers 122 would be difficult to manufacture with the provision of the projecting lugs 122*a* thereon, thus significantly increasing the manufacture cost. Second, since the bottom rollers 122 on the feed-out roller set 120 are not to be manufactured by the same specification as the bottom rollers 112 on the feed-in roller set 110, manufacture cost can not be reduced. And third, when the projecting lugs 122*a* are urging against the sheet, the sheet usually would shake, thus causing vibration to the scanner, which would significantly affect the quality of the scanned images.

Referring to FIG. 3, a second conventional solution to the foregoing problem is to provide a flanged portion 122*b* with a rough surface having a high frictional factor at each of the two ends of the bottom roller 122. Once the whole of the sheet S is fed out of the feed-out roller set 120 and has its tail edge left abutting on the bottom roller 122, the flanged portion 122*b* , due to the rotation of the bottom roller 122 and its high frictional surface, would drive the entire sheet off the bottom roller 122 by frictional force, thereby allowing the sheet to fall on the receiving tray T.

The foregoing solution also has the drawbacks of being difficult to manufacture and not allowing the feed-out roller set and feed-in roller set to use the same type of bottom roller for assembly. Manufacture cost is therefore high.

SUMMARY OF THE INVENTION

It is therefore a primary objective of the present invention to provide an apparatus for sheet feed-out control which allows the sheets to be piled up neatly on the receiving tray after being scanned.

It is another objective of the present invention to provide an apparatus for sheet feed-out control which can be manufactured with low cost.

It is still another objective of the present invention to provide an apparatus for sheet feed-out control which would not cause vibration to the scanner.

In accordance with the foregoing and other objectives of the present invention, a new and improved apparatus for sheet feed-out control is provided. The apparatus according to the present invention comprises a set of feed-in rollers for feeding the sheet into a scanning position where the scanning process is performed and a set of feed-out rollers including at least a top roller and a bottom roller for drawing the sheet away from the scanning position. A pivotal pressing member is pivotally affixed proximate to the feed-out rollers in such a way as to allow the free end of the pivotal pressing member to rest on the bottom roller on the feed-out rollers when the sheet is not being fed out of the feed-out roller set. With the foregoing arrangement, the pivotal pressing member is pivotally turned by the sheet as the sheet is being fed out of the feed-out rollers, and the pivotal pressing member presses down against the tail edge of the sheet as the sheet is entirely fed out of the feed-out roller set, thus allowing the sheet to be entirely drive away from the feed-out roller set.

Since the sheet can be placed flat on the receiving tray right after it is entirely fed out of the feed-out roller set, a stack of sheets can be piled up neatly on the receiving tray after being scanned.

Further, since the feed-out roller set and the feed-in roller set can be made according to the same specification, i.e., the type of the bottom roller used on the feed-out roller set can also be used as the bottom roller on the feed-in roller set, manufacture cost is significantly reduced.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
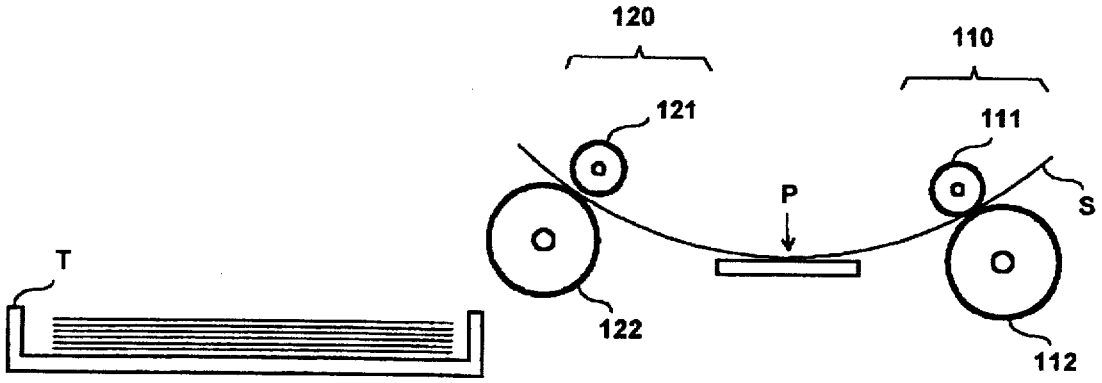
FIG. 1 (PRIOR ART)
FIG. 1 shows a schematic side view of a conventional automatic sheet feeder.
Figure 2:
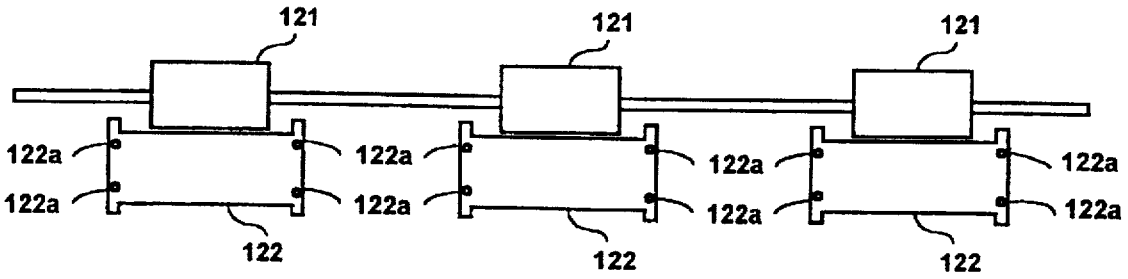
FIG. 2 (PRIOR ART)
FIG. 2 shows a schematic front view of the conventional automatic sheet feeder of FIG. 1.
Figure 3:
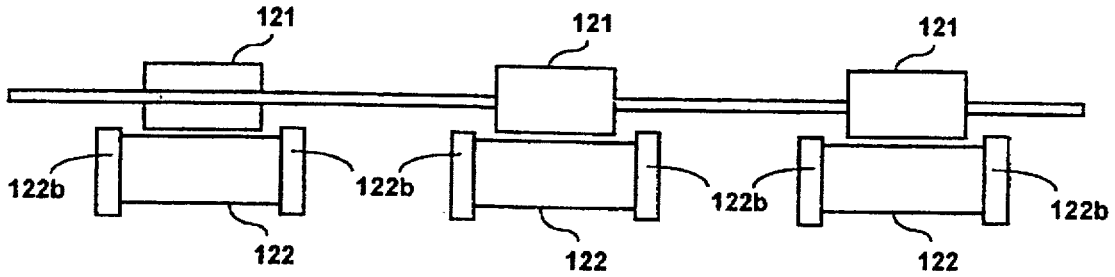
FIG. 3 (PRIOR ART)
FIG. 3 shows a schematic side view of another conventional automatic sheet feeder.
Figure 4A:
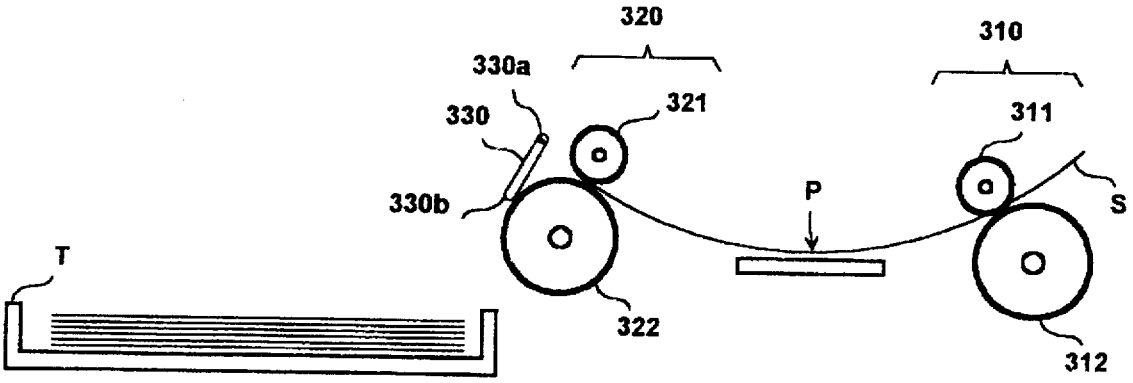
FIGS. 4A–4C are schematic side views of an automatic sheet feeder utilizing an apparatus for sheet feed-out control according to the present invention, depicting respectively three stages during which a sheet is being fed through a scanning process.
Figure 4B:
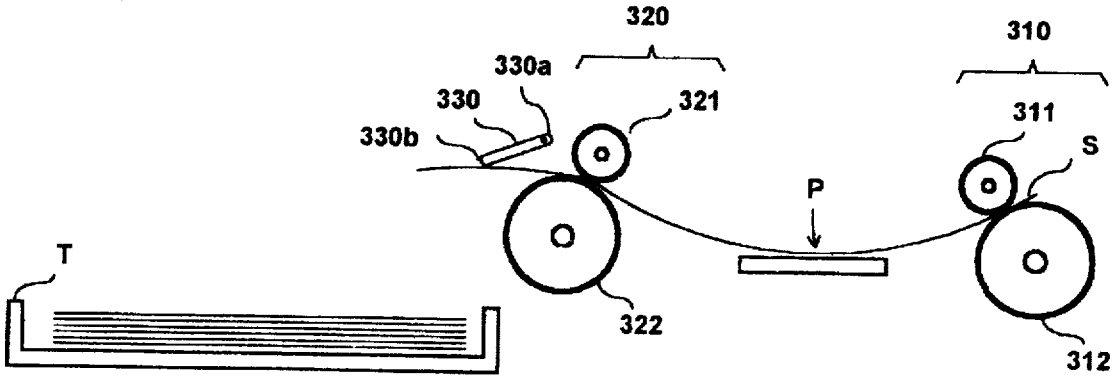
Figure 4C:
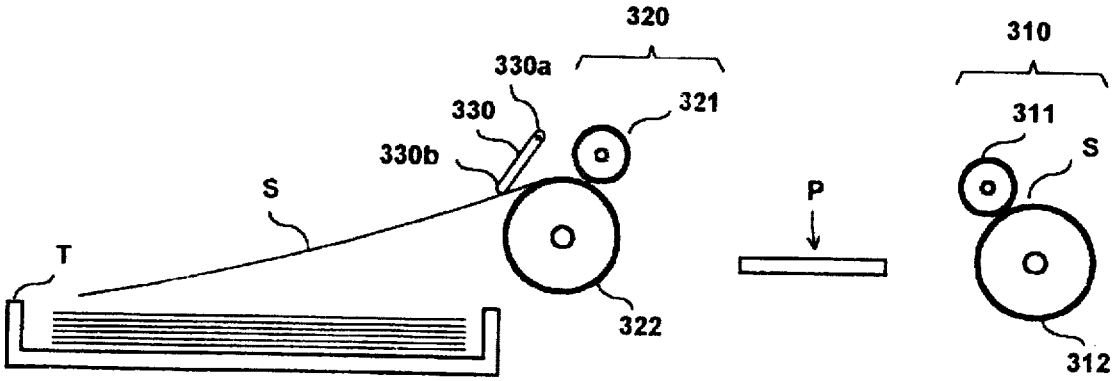

Referring to FIGS. 4A–4C, there are shown schematic side views of an automatic sheet feeder utilizing an apparatus for sheet feed-out control according to the present invention. As shown in FIG. 4A, the automatic sheet feeder is composed essentially of a feed-in roller set 310 including at least a top roller 311 and a bottom roller 312 for feeding a sheet S into a scanning position P in the scanner and a feed-out roller set 320 including at least a top roller 321 and a bottom roller 322 for pulling the sheet S away from the scanning position P and eventually delivering the sheet S onto a receiving tray T.

It is a characteristic part of the present invention that a pivotal pressing member 330 having a pivoted end **330*a* and a free end 330*b* is pivotally provided at the outlet of the feed-out roller set 320. The pivotal pressing member 330 is provided in such a manner that its pivoted end 330*a* is affixed at a position slightly higher than the outlet of the feed-out roller set 320 and its free end 330*b* rests by gravitation on the bottom roller 322**.

Figure 5:
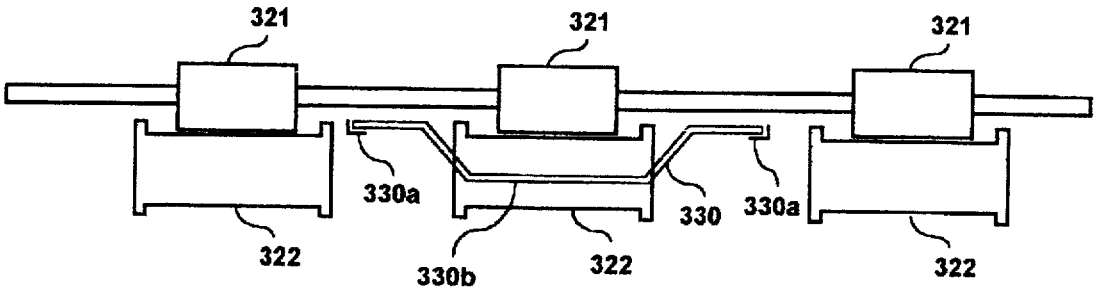
FIG. 5 shows a schematic front view of the apparatus of FIGS. 4A–4C.

In preferred embodiment, as shown in FIG. 5, the pivotal pressing member 330 is a near U-shaped bar having its two free ends serving as the pivoted end **330*a* mentioned above and pivotally affixed at suitable places on the body of the scanner. The weight of the pivotal pressing member 330 is adjusted corresponding to the weight of the sheets being scanned through the scanner. Preferably, the weight of the pivotal pressing member 330** is in the range from 2 g (gram) to 6 g for commonly used office sheets.

As further shown in FIG. 4B, as the sheet S is being fed out of the feed-out roller set 320, its leading edge will push against the pivotal pressing member 330. Since the pivotal pressing member 330 is pivotally fixed at one end, the pivotal pressing member 330 will swing to the left using the pivoted end **330*a* as rotational center, thus allowing the sheet S to pass through the beneath of the pivotal pressing member 330**.

As further shown in FIG. 4C, as the sheet S is entirely fed out of the feed-out roller set 320, the free end **330*b* of the pivotal pressing member 330 will press down by its weight against the tail edge of the sheet S, thus causing an increased frictional force between the sheet T and the bottom roller 322 whereby the tail edge of the sheet S could be pushed easily away by the bottom roller 322 from the feed-out roller set 320**. The sheet S can then fall freely by gravitation onto the receiving tray T.

Since each sheet can be placed flat on the receiving tray T right after it is entirely fed out of the feed-out roller set 320, a stack of sheets after being scanned can be piled up neatly on the receiving tray T.

Further, since the feed-out roller set 320 and the feed-in roller set 310 can be manufactured according to the same specification, i.e., the bottom roller 322 on the feed-out roller set 320 can also be manufactured according to the same specification as the bottom roller 312 on the feed-in roller set 310. Manufacture cost thus can be significantly reduced.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An apparatus for feed-out control of a sheet, comprising:

(a) a set of feed-out rollers including at least a top roller and a bottom roller for feeding out the sheet, each of said rollers having a longitudinal dimension; and (b) a pivotal pressing member having a pivoted end and a free end, said pivotal pressing member being pivotally affixed proximate to said feed-out rollers and above said bottom roller in a direction of gravity in such a way as to allow the free end of said pivotal pressing member to rest on said bottom roller of said feed-out roller set when the sheet is not being fed out of the feed-out roller set and to provide a pressure uniformly along the longitudinal dimension of said bottom roller;

wherein said pivotal pressing member comprises a substantially U-shaped bar, said U-shaped bar having two pivoted ends at opposite distal ends thereof, said pivoted ends being supported outside of the longitudinal dimension of said bottom roller, said pivotal pressing member is pivotally turned by the sheet as the sheet is being fed out of said feed-out rollers, and said pivotal pressing member presses down against the tail edge of the sheet and applies a uniform pressure as the sheet is entirely fed out of the feed-out roller set, thus causing an increased frictional force between the sheet and the bottom roller which allows the sheet to be pushed away by said bottom roller from said feed-out roller set.

2. An apparatus for feed-out control of a sheet, comprising:

(a) a set of feed-out rollers including at least a top roller and a bottom roller for feeding out the sheet, each of said rollers having a longitudinal dimension; and (b) a pivotal pressing member having a pivoted end and a free end, said pivotal pressing member being pivotally affixed proximate to said feed-out rollers and above said bottom roller in a direction of gravity in such a way as to allow the free end of said pivotal pressing member to rest on said bottom roller of said feed-out roller set when the sheet is not being fed out of the feed-out roller set and to provide a pressure uniformly along the longitudinal dimension of said bottom roller;

wherein said pivotal pressing member comprises a substantially U-shaped bar, said U-shaped bar member having two pivoted ends at opposite distal ends thereof, said U-shaped bar member having a flat portion adjacent said bottom roller in its longitudinal direction and outwardly bent portions toward said pivoted ends, said pivotal pressing member is pivotally turned by the sheet as the sheet is being fed out of said feed-out rollers, and said pivotal pressing member presses down against the tail edge of the sheet and applies a uniform pressure as the sheet is entirely fed out of the feed-out roller set, thus causing an increased frictional force between the sheet and the bottom roller which allows the sheet to be pushed away by said bottom roller from said feed-out roller set.

* * * * *